US010583687B2

(12) United States Patent
Fox et al.

(10) Patent No.: US 10,583,687 B2
(45) Date of Patent: Mar. 10, 2020

(54) REEL-TO-REEL CHALK LINE SYSTEM AND METHOD

(71) Applicants: Daniel S. Fox, Sandy, UT (US); Wayne Smedley, Kerns, UT (US); Joe Fox, Spanish Fork, UT (US)

(72) Inventors: Daniel S. Fox, Sandy, UT (US); Wayne Smedley, Kerns, UT (US); Joe Fox, Spanish Fork, UT (US)

( * ) Notice: Subject to any disclaimer, the term of this patent is extended or adjusted under 35 U.S.C. 154(b) by 247 days.

(21) Appl. No.: 15/859,685

(22) Filed: Jan. 1, 2018

(65) Prior Publication Data

US 2019/0030945 A1 Jan. 31, 2019

Related U.S. Application Data

(60) Provisional application No. 62/536,973, filed on Jul. 25, 2017.

(51) Int. Cl.
*B44D 3/38* (2006.01)
*B25H 7/04* (2006.01)

(52) U.S. Cl.
CPC ..... *B44D 3/38* (2013.01); *B25H 7/04* (2013.01); *B65H 2701/357* (2013.01)

(58) Field of Classification Search
CPC ..... B44D 3/38
USPC ..... 33/413, 414, 756
See application file for complete search history.

(56) References Cited

U.S. PATENT DOCUMENTS

| | | | | |
|---|---|---|---|---|
| 2,749,618 | A * | 6/1956 | Landon | A41H 23/00 33/414 |
| 3,046,663 | A * | 7/1962 | Romero | B44D 3/38 33/354 |
| 3,126,637 | A * | 3/1964 | Short | B44D 3/38 33/414 |
| 3,191,308 | A * | 6/1965 | Lindenau | G01B 3/1041 33/414 |
| 6,393,709 | B1 * | 5/2002 | Jones | B44D 3/38 33/414 |
| 6,957,495 | B1 * | 10/2005 | Schmillen | B44D 3/38 33/413 |
| 2003/0221325 | A1 * | 12/2003 | Dekort | B44D 3/38 33/414 |
| 2005/0076520 | A1 * | 4/2005 | Vary | B44D 3/38 33/414 |

(Continued)

*Primary Examiner* — George B Bennett

(57) ABSTRACT

An apparatus and method for a reel-to-reel chalk line comprising a first housing comprising a first impregnated chalk line reel, a first rotatable crank mechanism connected to the first reel, and a first chalk bin comprising apertures for allowing the passage of a continuous impregnated chalk line. The apparatus further comprises an opposed second housing comprising a second rotatable reel, a second crank mechanism connected to the second reel, and a second chalk bin comprising apertures for allowing passage of the continuous impregnated chalk line. The continuous impregnated chalk line is reeled about the first and second reels as the respective crank mechanisms are alternately rotated forward and backward. The chalk may include a variety of substances including reactive powders, liquids, dyes, glass, minerals, plastics, ceramics, metals, and fibers. The continuous chalk line may comprise interconnected impregnated chalk lines joined by mechanical or chemical means forming the continuous impregnated chalk line.

19 Claims, 10 Drawing Sheets

(56) References Cited

U.S. PATENT DOCUMENTS

| | | | | |
|---|---|---|---|---|
| 2008/0236442 | A1* | 10/2008 | Spaulding | B44D 3/38 106/31.01 |
| 2010/0011599 | A1* | 1/2010 | Johnson | B44D 3/38 33/414 |
| 2016/0052332 | A1* | 2/2016 | DeLeo | B44D 3/38 33/414 |
| 2016/0167425 | A1* | 6/2016 | Chernyshou | C09D 13/00 33/414 |
| 2016/0375720 | A1* | 12/2016 | Henderson | B44D 3/38 33/414 |

* cited by examiner

REEL-TO-REEL CHALK LINE SYSTEM AND METHOD

RELATED APPLICATIONS

This application claims priority to U.S. Provisional Application, Ser. No. 62/536,973, filed Jul. 25, 2017, the entire contents of which are incorporated by reference.

BACKGROUND

The present disclosure relates to a reel-to-reel chalk line apparatus and method.

A chalk box is a device or apparatus used to provide chalk marks (impregnated lines) on a work surface, e.g., a concrete, wood, asphalt, ceramic etc. surface. The chalk box includes a string or an impregnated line on which a chalk substance (typically powder) can be provided. The chalk substance is transferred to the work surface by snapping the impregnated line after it has been made taut over the surface to be marked. The impregnated line can be wound onto a rotatable reel inside the chalk box housing for storage. The chalk box stores the chalk substance as well as the impregnated line, and can be refilled with additional chalk substance when the chalk substance runs out.

The present disclosure provides improvements over prior art chalk boxes. A disadvantage in using a known chalk box over a relatively long distance is that one or two people may be required to operate the chalk line. Typically, a one-person user affixes one end of the line to a fixed location and then travels the distance to be marked before snapping the line and then goes back to unfix the line, all the while reeling the impregnated chalk line in and out of the chalk box. This process may be repeated a number of times, when multiple lines are required. Over relative long distances, two people are preferred. One person holds the chalk box and the second person travels the distance to be marked carrying the line along the way. Once the line is snapped, the second person returns the line to the first person, while the first person rewinds the impregnated line into the chalk box to reload the line with chalk. When multiple lines are required, this process is repeated with the second person going back and forth repeatedly. The present invention provides a solution to the inefficient use of the current technology, especially when chalking long lines repeatedly. The reel-to-reel chalk box apparatus as disclosed herein is adaptable to a variety of chalk box designs. The following specification discloses improvements to an exemplary design as disclosed in U.S. Pat. No. 8,713,810, to Spaulding.

SUMMARY

A continuous reel-to-reel chalk line apparatus and method, comprising first and second juxtaposed chalk boxes or housings in tandem comprising a first housing comprising a first rotatable reel (first reel), a first crank mechanism connected to the first reel, and a first chalk bin comprising apertures for allowing the passage of a continuous impregnated chalk line. A second housing comprising a second rotatable reel (second reel), a second crank mechanism connected to the second reel, and a second chalk bin comprising apertures for allowing passage of the continuous impregnated chalk line, and the continuous impregnated chalk line being wound and unwound about the respective reels as the respective crank mechanisms are alternately rotated forward and backward in such a manner that the continuous impregnated chalk line goes back and forth between the respective reels. In this way, the continuous impregnated chalk line is reloaded with chalk as it travels back and forth between the reels. There is no need for a second person to travel back and forth over and over again when chalking long repeated chalk lines.

The continuous reel-to-reel chalk line apparatus may include a visual indicator positioned at a point along the chalk line to indicate the amount of line wound up or let out from the apparatus. The visual indicator may include, for example, a colorization of the line, a texturization of the line; a physical artifact positioned on the line such as a bead, a button, a clasp, a symbol, a ribbon, hook, or a string. The visual indicator may be stationary, removeable, or a slidable visual indicator to mark a desired amount of line reeled in or reeled out. The visual indicator may function to join the impregnated chalk line with a second impregnated chalk line.

The crank mechanisms of the chalk line apparatus may comprise gears connected to the respective reels. The gears permit the crank mechanism to rotate the respective reels in such a manner as to pay out the impregnated chalk line and to reel it in. The gears may comprise a planetary gear configuration that enable ease of operation of the crank mechanism.

The continuous reel-to-reel chalk line apparatus may comprise automated crank mechanisms comprising a battery powered motor for actuating the respective reels. The respective crank mechanisms may comprise a rechargeable battery powered motor for actuating the respective reels. The apparatus as disclosed herein may comprise both a hand crank mechanism and a battery powered mechanism.

The continuous reel-to-reel chalk line apparatus may comprise a plurality of chalk bins. The respective chalk bins may comprise a chalk substance suitable for impregnating the continuous chalk line as it passes through the chalk bin. The respective chalk bins may comprise separate compartments for storing chalk substances comprising assorted colors and mixtures. The chalk substances may comprise a mineral powder, a liquid, a dye, a metal, a ceramic, a glass, a plastic, and or a fiber, or combinations thereof. The chalk substance, or components of the chalk substance, may be fluorescent and or reactive to light, for example reactive to a particular light wave, including natural, infrared or ultraviolet light waves. The chalk substance may emit detectable emissions, such as nuclear emissions. An exemplary fluorescent material may comprise calcite, agate or other fluorescent minerals including diamond particles. The continuous impregnated chalk line may comprise a weave, braid, and or adhesive, or different weaves, braids, and or adhesives, or other structures designed to hold the chalk in such a manner that only a portion of the chalk is released when the chalk line is snapped.

The continuous reel-to-reel chalk line apparatus may comprise a visual display showing the length of the continuous impregnated chalk line dispensed. Also, the respective housings may comprise a visual alarm as the chalk substance is depleted from the chalk bins. The alarm may also include an audible alarm and/or a vibrating alarm as the chalk substance is depleted from the bins.

The continuous reel-to-reel chalk line apparatus wherein the first reel and the second reel each have the capacity to reel in substantially the entire length of the continuous impregnated chalk line. Furthermore, the first reel and the second reel may have different capacities to reel in the continuous impregnated chalk line.

The first housing and the second housing may comprise different external appearances as well as different crank mechanisms and bins for reeling the continuous impregnated chalk line. The continuous impregnated chalk line may also comprise a combination of chalk line styles and structures.

In order to promote smooth operation of the crank mechanisms, the chalk bins may be sealed so that little or no chalk can contaminate the components of the crank mechanisms and the reels. Accordingly, the respective chalk bins may comprise a sealable opening for refilling the respective chalk bins with the chalk substances. The openings may provide user access to the internal components of the respective housings.

The continuous impregnated chalk line as disclosed herein may comprise one or more attached impregnated chalk lines. For example, two separate chalk box housing apparatuses may be combined by connecting their respective impregnated chalk lines to form a single continuous impregnated chalk line. Such lines may be connected by means of knots, braids, brackets, pins, nails, sticks, barbs, wires, springs, hooks, clasps, and or adhesives, or a combination thereof.

An embodiment of the apparatus of this disclosure relates to opposed chalk boxes including housings with an opening and a rotatable reel disposed within each of the housings. A continuous impregnated line is arranged to be wound continuously on the respective reels. Crank mechanisms are provided to rotate the reel to wind the impregnated line on the reel. Movable covers are mounted to the housings and are movable between an open position and a closed position, the covers when open permit chalk in its various forms, including a powder or a fluid marker material, which may include a dye and other components, to be placed into the housings through the openings in the housings. The movable covers include an elastomeric material and a relatively rigid material, the elastomeric material enabling the covers to seal with the housings when the covers are closed to prevent leakage of the marker materials at an interface between the movable covers and the housings through the openings. The elastomeric materials are overmolded onto and thus permanently connected to the relatively rigid materials of the movable covers. A releasable lock is arranged on each housing to releasably lock the covers in the closed position, the releasable locks being manually manipulable by a user's fingers to release the locks to permit access into the housings.

Another aspect of the disclosure relates to a chalk box including a housing having an opening. A movable cover is attached to the housing, the movable cover may be arranged to move between an open position and a closed position to selectively permit or prevent access to an interior of the housing through the opening. A rotatable reel is disposed within the housings. A windable continuous impregnated chalk line has a portion thereof wound on the respective reels and another portion thereof extending through a hole in the movable covers to the outside of the housings. The openings in the housings are positioned and sized to enable the user to manually engage the portion of the impregnated line wound on the reel when the cover is in the open position. The openings also permit chalk substances or other marker material to be placed into the housing when the cover is in the open position.

Yet another aspect of the disclosure relates to a pivotable cover mounted to the respective housings and is movable between an open position and a closed position, the pivotable cover having an opening therethrough to provide an outlet/inlet for the impregnated chalk line. The pivotable covers when open permit a powder or a fluid marker material to be placed into the housings through the opening in the housings. A releasable lock is arranged on the covers to releasably lock the covers in the closed position, the releasable locks are manually manipulable by a user's fingers to release the locks to permit access into the housings.

These and other aspects of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one aspect of the disclosure, the structural components illustrated herein can be considered drawn to scale. It is to be expressly understood, however, that the drawings are for illustration and description only and are not intended as a definition of the limits of the disclosure. It shall also be appreciated that the features of one aspect disclosed herein can be used in other aspects disclosed herein.

DETAILED DESCRIPTION

The various components and uses of the apparatus and method disclosed herein will be described in relation to the components and methods individually and as combined to form the reel-to-reel chalk box apparatus and method of this disclosure.

A reel-to-reel chalk box housing (housing) apparatus in accordance with one aspect of the disclosure is shown in FIG. 1. First and second reel-to-reel chalk box housings 10 are juxtaposed linearly opposite one another and connected by a continuous impregnated chalk line 14. As the first reel-to-reel chalk box reels in the continuous impregnated chalk line 14, the line freshly loaded with chalk is reeled out from the second reel-to-reel chalk box. In this manner users of the apparatus may stand at a distance while snapping chalk multiple chalk lines on a work surface without having to return the line to the opposite user in order to refresh the chalk line. A visual indicator 9 may be positioned along the continuous impregnated chalk line 14. Visual indicator 9 may be used to mark the amount of continuous impregnated chalk line 14 that has been reeled in or out. Visual indicator 9 may also be used to attach a second impregnated chalk line to the continuous impregnated chalk line 14, the combined impregnated chalk lines, thus, forming the continuous impregnated chalk line 14. The visual indicator 9 may include, for example, a colorization of the line, a texturization of the line; a physical artifact positioned on the line such as a bead, a button, a clasp, a hook, a symbol, a ribbon, or a string. The visual indicator 9 may be stationary, removeable, or a slidable visual indicator to mark a desired amount of impregnated chalk line reeled in or reeled out.

Figure 1A:
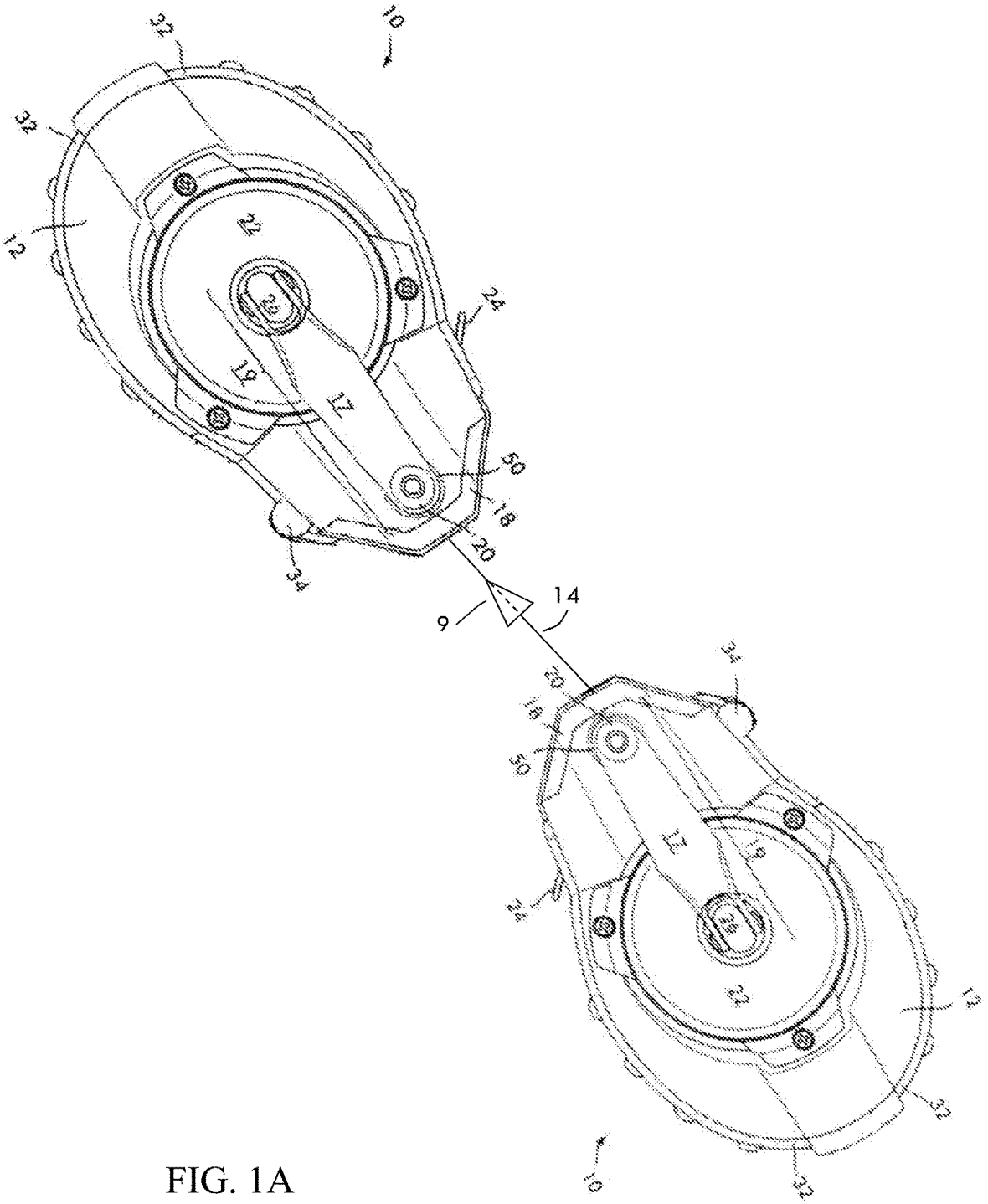
FIG. 1A shows diagrammatic side view of a reel-to-reel chalk box apparatus, in accordance with an aspect of the present disclosure.
Figure 1B:
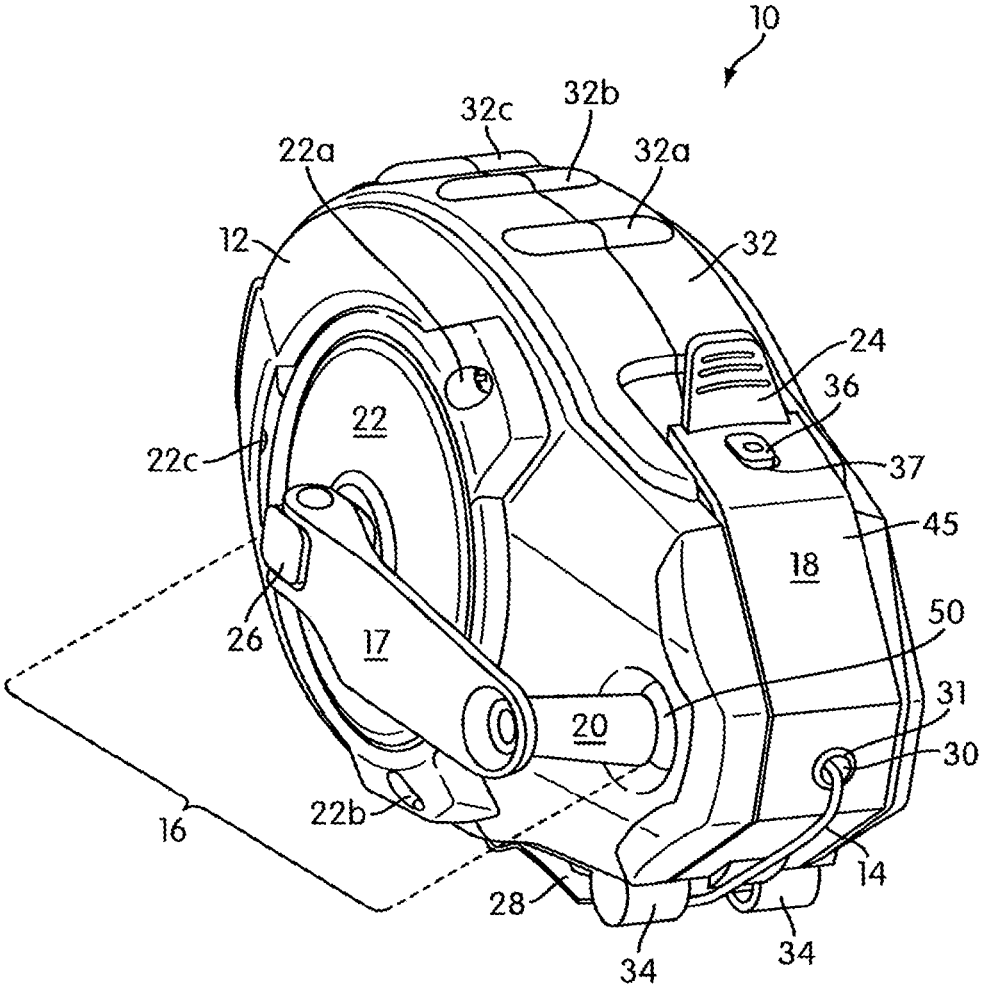
FIG. 1B shows a view of a chalk box housing, in accordance with an aspect of the present disclosure.
Figure 1C:
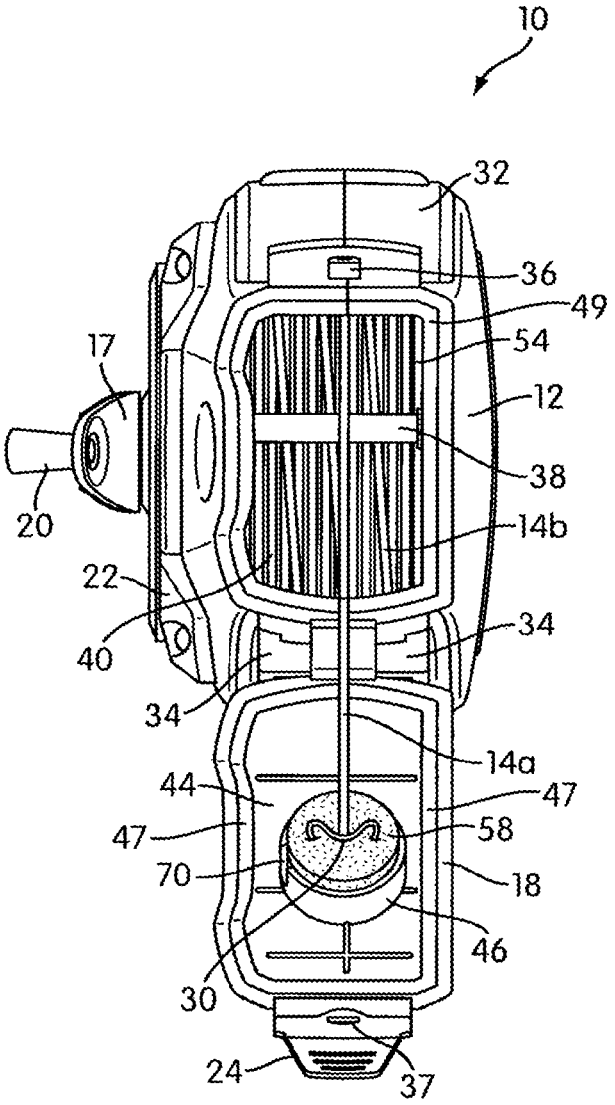
FIG. 1C shows a top view of the chalk box housing with the cover open, in accordance with an aspect of the present disclosure.
Figure 3:
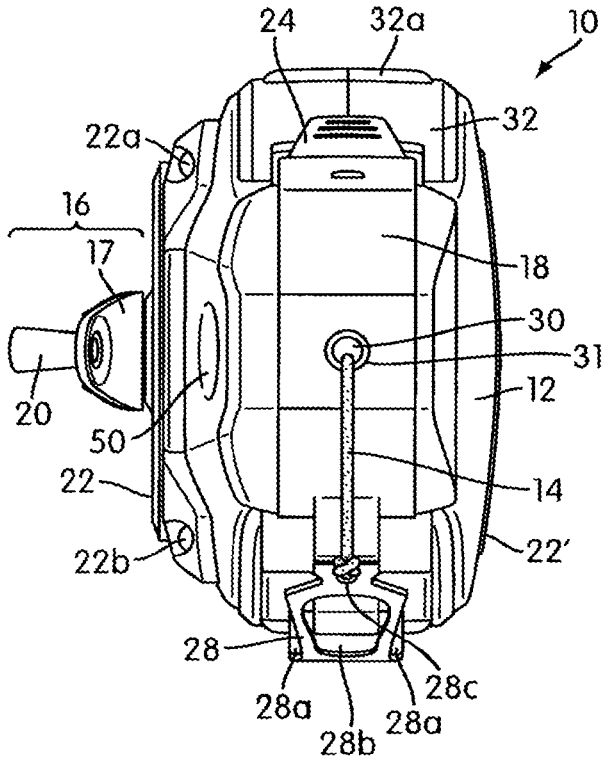
FIG. 3 shows a front view of the reel-to-reel chalk box housing, in accordance with an aspect of the present disclosure.
Figure 5A:
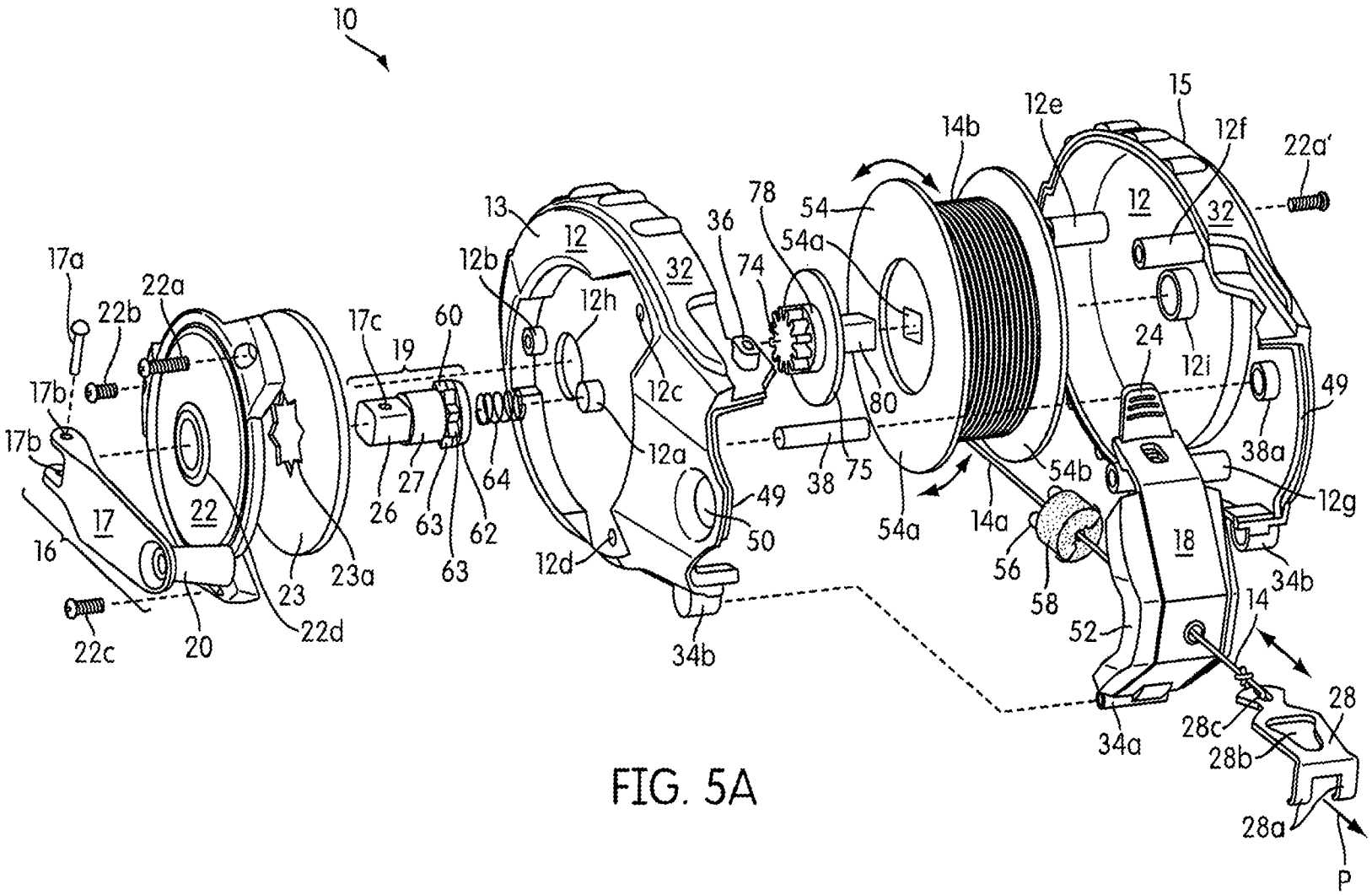
FIG. 5A shows an exploded view of the reel-to-reel chalk box housing, in accordance with an aspect of the present disclosure.

Each of the reel-to-reel chalk line box housings as shown in FIGS. 1A, 1B, and 1C include a chalk box housing 12 and a movable cover 18 mounted on housing 12. In FIG. 1C, movable cover 18 is shown in the closed position, whereas in FIG. 1C movable cover 18 is shown in an open position. In one embodiment, the movable cover 18 may be pivotally connected to housing 12, although a slidable or rotatable cover is also contemplated. Nevertheless, movable cover 18 is interchangeably referred to herein as pivotable cover 18. Referring to FIG. 1C, mounted on the exterior of housing 12 is a reel crank arm 16 arranged to rotate a rotatable reel 54 (reel 54) (shown in more detail in FIGS. 1C and 5A) disposed within housing 12. Reel crank arm 16 in one embodiment is constructed with a continuous part 17, a handle 20 at one end of continuous part 17, and a pivot structure 19 (shown in FIG. 5A) at the other end, with the mounting hub portion 26 of pivot structure 19 shown in FIG. 1C. Pivot structure 19 further includes a cylindrical portion 27 attached to the mounting hub portion 26 on one side and a gear member 60 having teeth 63 on another side (shown in FIG. 5A). The continuous part 17 is pivotally mounted on the mounting hub portion 26 of the pivot structure 19 by a pivot pin 17*a*, so that reel crank arm 16 can be moved from a rest position wherein a distal end of the handle 20 rests in a recess 50 on housing 12, to an operational position in which the distal end of handle 20 faces away from the housing 12 (as shown in FIG. 3). As seen in FIG. 5A, a housing cap 22 is joined to housing 12 by a plurality of screws 22*a*-22*c*, although other mechanisms for fixing housing cap 22 to housing 12 (e.g., a latch mechanism), as well as other number of screws may be used.

Figure 7:
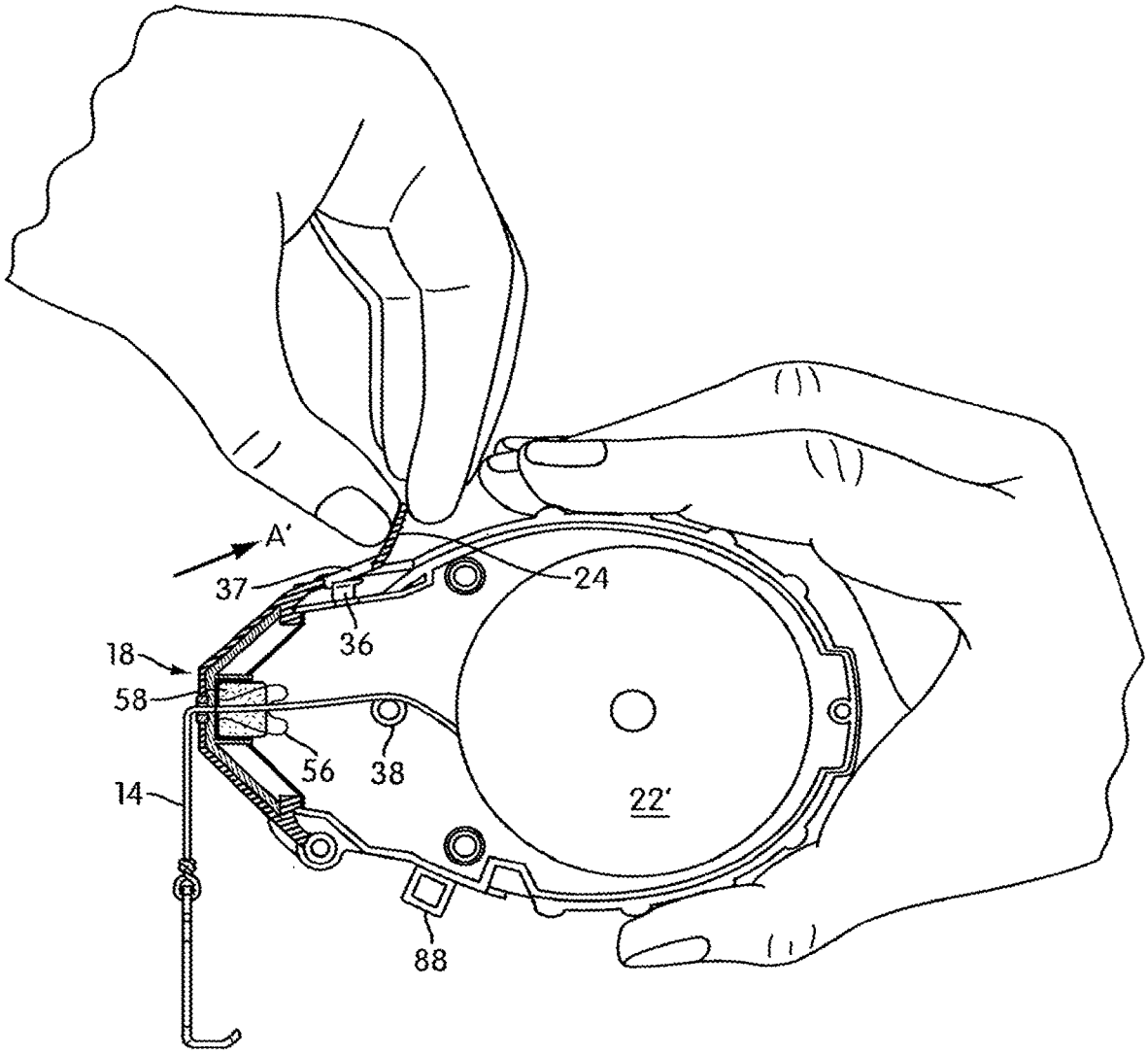
FIG. 7 shows an enlarged view of a projection formed on the reel-to-reel chalk box housing and an opening in a tab formed on the movable cover, and shown being moved to releasably lock the cover in a closed position.
Figure 8:
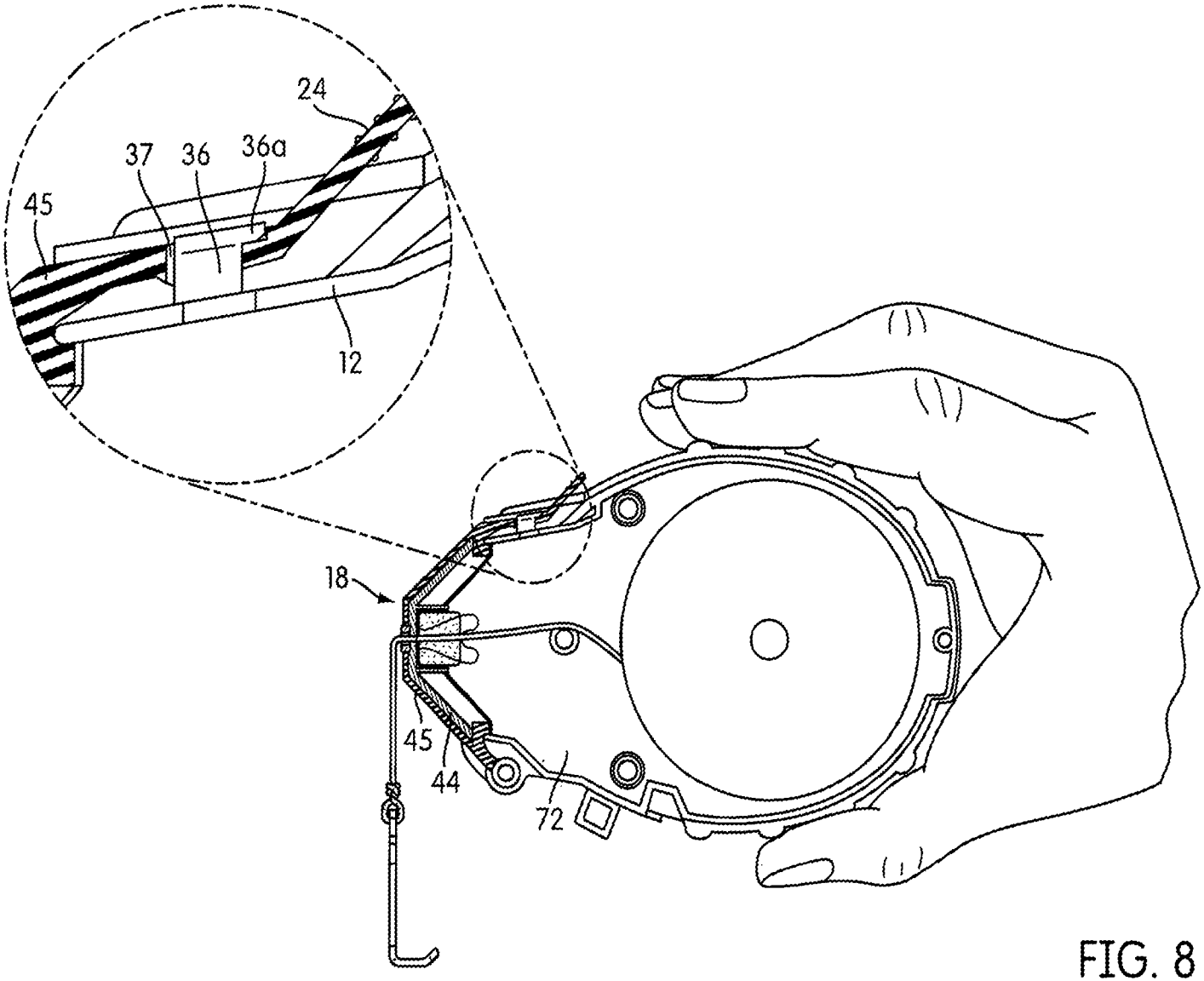
FIG. 8 is a close-up view of the movable cover in a locked or closed position with the reel-to-reel chalk box housing, in accordance with an aspect of the present disclosure.

As shown in FIGS. 7 and 8, for example, in one embodiment, movable cover 18 includes an elastomeric material 45 that forms an elastic tab 24 that can be stretched over a protrusion 36 on housing 12, so that protrusion 36 is received in a recess or opening 37 in the elastic tab 24 of movable cover 18 to lock the cover in a closed position relative to the housing 12. Elastic tab 24 is also referred to herein as a projection 24. The elastomeric material 45 of cover 18 can be formed of rubber, or other types of elastic or elastomeric material including but not limited to polysulphide rubber, polyacrylic rubber, silicone rubber, other types of unsaturated rubbers, saturated rubbers including but not limited to isopropene rubber; polybutadiene rubber, resilin, elastin, and the like, and combinations thereof. The engagement of protrusion 36 into opening 37 releasably locks the cover 18 in a closed position. As noted above, in this example, projection 24 forms a manually engageable tab that facilitates an opening and/or a closing of movable cover 18. The stretchability (elasticity) of elastomeric material 45 over protrusion 36 is sufficient to prevent accidental opening of movable cover 18, without a need for additional mechanism(s) to prevent such accidental opening of movable cover 18. In one embodiment, movable cover 18 is the only cover provided on housing 12 to seal an opening 40, which may serve as access to chalk bin 72, into which chalk marker material can be filled, and/or through which an inside portion of housing 12 can be accessed by a user, as shown in FIG. 1C. It is to be noted that in chalk box 10, both (a) access to rotatable reel 54 and (b) depositing the marker material into the housing 12 can be accomplished in a one-step procedure of opening the movable cover 18.

Opening 40 is shown, for example, in FIG. 1C, wherein movable cover 18 is shown in an open position. In one embodiment, opening 40, is the only access to deposit chalk or marker material into the chalk bin 72 of housing 12, and is sufficiently large to provide the user with one or two finger access to a portion of a continuous reel-to-reel chalk impregnated line 14 inside housing 12 wound on rotatable reel 54 (seen in FIG. 5A). In one embodiment, movable cover 18 pivots about one or more pivots 34, between open and close positions. The pivot 34 may be a pin type hinge, a living hinge formed by the elastic or elastomeric material 45, or any other type of pivot or hinge. When in a closed position, movable cover 18 seals with housing 12 to prevent leakage of chalk or marker material at an interface between movable cover 18 and housing 12. The elastic or elastomeric material 45 forming part of the cover 18 facilitates this sealing function. Movable cover 18 includes a hole or an opening 30 therethrough that provides an outlet for a continuous portion of impregnated chalk line 14 to extend outside housing 12. In use, continuous impregnated chalk line 14 is windable and is made of a material that facilitates the adherence of chalk substances thereto for marking a surface. The impregnated chalk line 14 may comprise a weave or braid or adhesive, or different weaves or braids or adhesives, or other physical structure that traps chalk substances and releases or partially releases the substances when the line is snapped. The chalk substances may comprise a reactive mineral powder, a liquid, a dye, a metal, a ceramic, a glass, a plastic, and or a fiber, or combinations thereof. The chalk substance, and or components of the chalk substance, may be florescent and or reactive to light, for example natural, infrared or ultraviolet light. The chalk substance, or components, may emit detectable emissions, such as nuclear emissions. An exemplary florescent material may comprise florescent minerals such as calcite, agate, or diamond particles. The continuous impregnated chalk line may comprise multiple weaves, braids or adhesives, or other structures designed to hold the chalk in such a manner that only a portion of the chalk is released when the continuous impregnated chalk line is snapped.

The continuous impregnated chalk line 14 can be wound on rotatable reel 54 (shown in more detail in FIGS. 1C and 5A) when reel crank arm 16 is operated by a user. It is to be noted that although continuous impregnated chalk line 14 is moved in and out of housing 12 using reel crank arm 16, in alternative aspects continuous impregnated chalk line 14 may be moved into the housing 12 using a one-way spring loaded winding mechanism that pulls continuous impregnated chalk line 14 into housing 12. The continuous impregnated chalk line 14 may be pulled out of the first chalk box housing 12 by a user reeling in the continuous impregnated chalk line by a second user operating the opposed second chalk box housing. In yet another alternative aspect, continuous impregnated chalk line 14 can be wound or unwound using a small battery-operated motor attached to and/or inside the respective housings 12. The battery may be a rechargeable battery.

Housing 12 can be formed of a plastic, or other suitable material, and optionally includes an overmolded covering 32 made, for example, of an elastomeric material, on a side surface to facilitate easy gripping by a user. The covering 32 may also optionally include one or more undulations or grooves 32*a*-32*c* for easy gripping.

Referring to FIG. 1C, another view of chalk box housing 10 with movable cover 18 in an open position to expose opening 40 in housing 12 is shown. In one embodiment of the disclosure, opening 40 may serve as the access to chalk bin 72 and has an area of at least 1⅜ square inches. For example, in one embodiment, opening 40 has a length of 1 inch and a width of 1⅜ inches, or vice-versa. In another embodiment, the opening 40 is greater than 2 square inches. In another embodiment, the opening 40 is greater than 3 square inches. In another embodiment, the opening is greater than 4 square inches. As shown in FIG. 5A, the continuous impregnated chalk line 14 typically has an extending portion 14*a* that extends generally tangentially from the reel 54, and a wound portion 14*b* that is wound on the reel 54. The wound portion 14*b* may be more or less the same amount for the first and second chalk boxes 10 as shown in FIG. 1. Also, the wound portion 14*b* may be substantially different for the first and second chalk boxes 10 as shown in FIG. 1. For example, wound portion 14*b* for the first chalk box 10 may be 20 yards of impregnated chalk line 14*b*, while the wound portion 14*b* of the second chalk box 10 may only be 10 yards. In some instances, the continuous impregnated chalk line 14 may break such that the continuous impregnated chalk line 14 becomes entirely contained within the housing 12. Opening 40 in housing 12 is positioned and sized to enable a user to manually engage with a finger (or two fingers) through the opening 40, the portion 14*a* of continuous impregnated line 14 to enable the user to pull on the impregnated line 14 and re-thread it through opening 40. For example, in one embodiment, opening 40 is sized to provide the user with one or two finger access to a portion of the continuous impregnated line 14 wound on the reel within housing 12 (e.g., portion 14*b* of continuous impregnated line 14, also shown in FIG. 5A). If two finger access is permitted, the user can pinch portion 14*b* of impregnated line 14 that may be on reel 54 to draw it out of housing 12 if the continuous impregnated chalk line 14 is broken and wrapped onto reel 54. Additionally, opening 40 permits chalk or other marker substances to be placed into chalk bin 72 of housing 12.

In one embodiment, portion 14*a* of continuous impregnated chalk line 14 may optionally be supported by an optional support member 38 (shown in FIGS. 1C and 5A) that facilitates guiding continuous impregnated chalk line 14 through hole or opening 30 on movable cover 18 by providing an outlet to continuous impregnated line 14. Support member 38 may also serve to connect housing halves 13 and 15, as seen and described with respect to FIG. 5A. The continuous impregnated chalk line 14 is wound up on rotatable reel 54 such that the chalk or marker material covers portions 14*a* and 14*b* before continuous impregnated line 14 is pulled out from hole 30 of movable cover 18 by the opposed reel for marking a surface using chalk box 10.

As seen in FIG. 1C, the movable cover 18 may also include a backing portion 44 made of a material relatively harder and/or more rigid than the elastomeric material 45 of the movable cover 18. In one embodiment, the elastomeric material 45 is overmolded onto and thus permanently connected to the relatively rigid material forming portion 44 of the movable cover 18. By way of example only and not by way of limitation, the relatively rigid material is a plastic, for example, an Acrylonitrile Butadiene Styrene (ABS) plastic. As can be appreciated from FIG. 1C and the cross-sectional view of FIG. 8, the more rigid portion 44 of cover 18 can be over-molded with the more resilient or elastomeric material 45 of the cover 18 (for example, in a two-shot molding process). As can be seen in FIG. 1C, the elastomeric material 45 is molded on top and around rigid portion 44. In one embodiment, elastomeric material 45 covers an entire exterior surface of movable cover 18. In one embodiment, an entire periphery 47 (also referred to as a peripheral elastic portion 47) of the cover 18 is molded with a thickened portion of elastomeric material 45. That thickened elastomeric portion making the periphery 47 projects from the more rigid portion of the cover 18 and is received within a peripheral groove 49 formed in the housing and surrounding the opening 40 within the housing 12. The peripheral elastic portion 47 and peripheral groove 49 form a sealed interface by compressing the peripheral elastic portion 47 between the cover 18 and the housing 12 when the cover 18 is locked in the closed position to fit tightly into the groove 49. As can also be appreciated from FIG. 1C, the projection or tab 24 is formed as an extension of the elastomeric material 45 beyond the structural area of more rigid portion 44. This permits projection 24 to be manually stretched by the user during a locking operation of cover 18, as will be described in FIGS. 2-8. As noted previously, the elastomeric material 45 may be formed from rubber, or other suitable material, while more rigid portion 44 may be formed from plastic, for example, Acrylonitrile butadiene styrene (ABS), or other suitable material. Portion 44 may include a cylindrical receptacle 46 extending into the housing 12 when cover 18 is closed. Receptacle or recess 46 is arranged to hold a seal structure 58 that aids in maintaining a steady pass through of portion 14*a* of continuous impregnated line 14 through hole 30. In addition, seal structure 58 may serve to create a seal about the continuous impregnated chalk line 14 to prevent leakage of marker material between the continuous impregnated chalk line 14 and a lip 31 surrounding the hole 30. This is accomplished as a result of the narrow passage formed in the seal structure 58, which may be formed from felt or felt like material. The impregnated line may pass through the narrow passage in the seal structure 58. In one embodiment, the seal structure 58 can be made of a sponge-like material and portion 44 can be made of same material as that used for housing 12. A clip 56 is optionally arranged to facilitate passage of the impregnated line portion 14*b* through the passage in the seal structure 58, although in some examples clip 56 may be omitted. Receptacle part 46 can be hollow to receive the seal structure 58, and include one or more cut-out grooves 70 to facilitate removal of the seal structure 58 if desired, for example, if rethreading a broken impregnated line 14 through the passage in the seal structure 58 is performed. In FIG. 1C, projection 24 includes the recess 37 through which protrusion 36 passes through, as described in more detail below, to form a releasable lock mechanism for movable cover 18.

Figure 2:
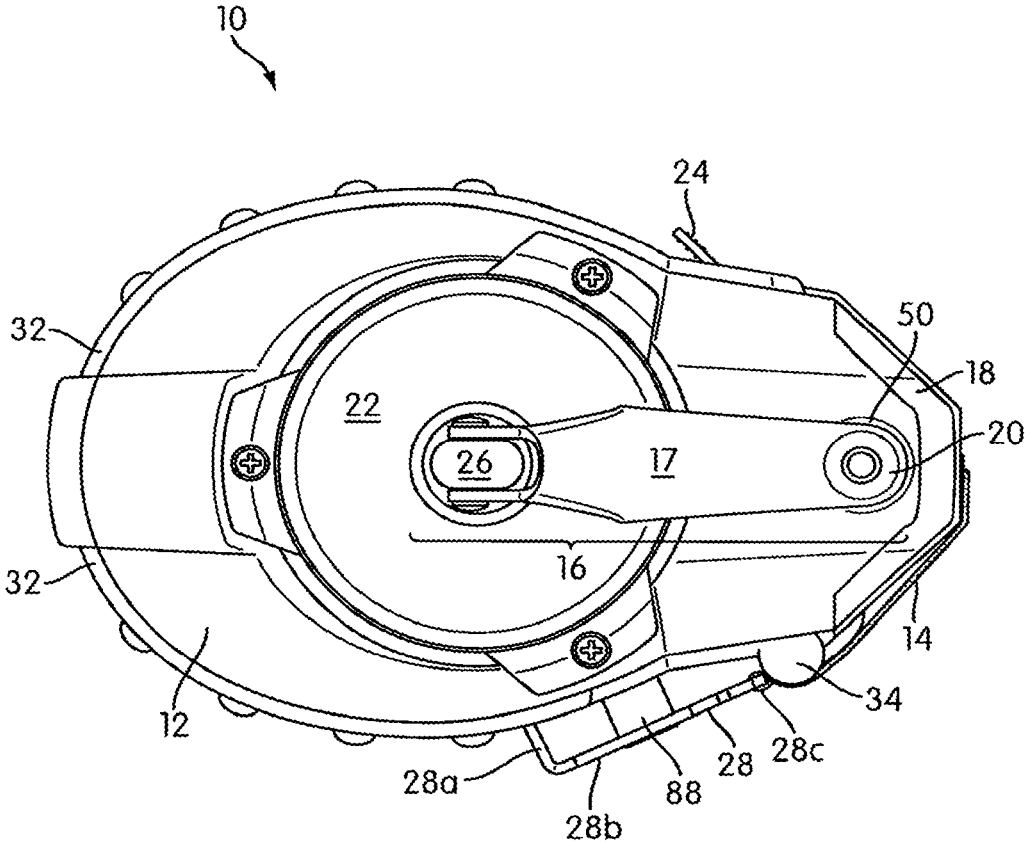
FIG. 2 shows a side view of one of the reel-to-reel chalk box housings, in accordance with an aspect of the present disclosure.

FIGS. 2 and 3 are side views and front views of chalk box 10, respectively. Elements of FIG. 2 are substantially similar to the elements shown in FIGS. 1A-1C. A side view of hook 28 is shown in more detail. When chalk box 10 is not in use, hook 28 rests over a protrusion 88, although other mechanisms for resting hook 28 may be used (e.g., a snap-on clip). Alternatively, protrusion 88 may be optional and hook 28 may hang from chalk box 10. Referring to FIG. 3, another view of hook 28 is shown in detail. Hook 28 may include one or more claws 28*a* for fixing continuous impregnated chalk line 14 to an end point or to a second impregnated chalk line, in use. Hook 28 may be removable to facilitate connection of continuous impregnated chalk line 14 to a second impregnated chalk line from a second chalk box housing, the impregnated chalk line 14 and the second impregnated chalk line forming the continuous impregnated chalk line 14 as may be shown in FIG. 1. Additionally, hook 28 may include a through-hole 28*c* for fastening continuous impregnated line 14, and another hole 28*b* for hanging chalk box 10, for example, on a nail in a wall for storage. Alternatively, hole 28*b* may also be used to fix continuous impregnated chalk line 14 to a projecting member or a work-piece where more suitable than claws 28*a*. The hook 28, as well and other means of mechanical and chemical attachment, may be used to attach the continuous impregnated chalk line 14 to a second impregnated chalk line as components of the continuous impregnated chalk line 14. When joining the continuous impregnated chalk line 14 with a second impregnated chalk line, hook may function as indicator 9 marking the amount of chalk line dispensed. Hole 28*b* may also be used to attach hook 28 to housing 12 over protrusion 88 (shown in FIG. 2), when chalk box 10 is not in use. FIG. 3 also illustrates an additional housing cap 22' on a side of housing 12 opposite to a side where reel winder 16 is arranged on housing cap 22. Additional cap 22' is optional and is arranged to enhance structural strength of chalk box housing 12.

Figure 4:
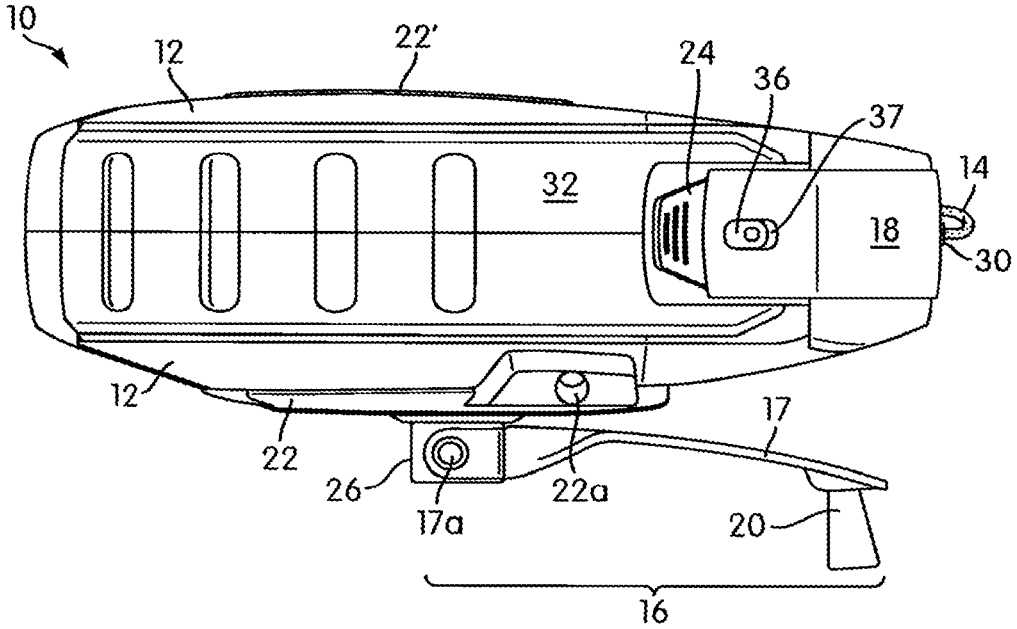
FIG. 4 shows a top view of the reel-to-reel chalk box with a handle of a crank mechanism of the reel-to-reel chalk box housing in an operating position, in accordance with an aspect of the present disclosure.

FIG. 4 is a top view of chalk box 10 with handle 20 of reel crank arm 16 shown in an operational position in contrast with the "at rest" position shown in FIG. 1C, for example. In the operational position, handle 20 faces away from housing 12 for a user to grip handle 20 and rotate the reel crank 16 to rotate reel 54 to take-up the continuous impregnated chalk line 14 and wind it into the reel 54. Reel crank arm 16 can be bought in the position shown in FIG. 4 by pivoting the reel crank arm 17 about fastener 17*a*.

Also in FIG. 4, protrusion 36 is shown. In one embodiment, the resilient projection 24 formed on pivotable cover 18 can be engaged by a user's fingers to move cover 18 to a closed position. Projection 24, when stretched, can enable the opening 37 in the elastomeric material 45 of cover 18 to be pulled to a position in which it can be placed over protrusion 36 to releasably lock cover 18 in the closed position. To release the lock, the projection 24 is stretched in a direction away from movable cover 18 to release projection 24 from the protrusion 36. This will unlatch or unlock movable cover 18 and enable it to be moved to an open position shown, for example, in FIG. 1C.

FIG. 5A is an exploded view of chalk box 10 showing internal and external structural arrangement details thereof, in accordance with one aspect of this disclosure. Starting from the left in FIG. 5A, reel crank arm 17 of reel crank 16 includes a pair of holes 17*b* to accommodate a fastener 17*a*. Fastener 17*a* also goes through a hole 17*c* on mounting hub 26 causing mounting hub 26 to be attached securely to arm 17 of reel crank 16. Housing cap 22 includes a hole 22*d* that accommodates the pivot structure 19 (which includes the cylindrical portion 27 attached to the mounting hub portion 26). Pivot structure 19 also includes the gear member 60 with teeth 63 and a circular portion 62. Member 60 is received into a similarly shaped hole 23*a* on an inner ring gear 23 rotatably received within housing cap 22, as illustrated in FIG. 5A. Also shown are plurality of screws 22*a*-22*c* that fit into their respective grooves as shown by the corresponding chained impregnated lines parallel to respective major axes of the screws. In this embodiment, screws 22*a*-22*c* extend through their respective grooves, via respective receptacles 12*c*, 12*b*, and 12*d*, into three cylindrical fasteners receiving protrusions 12*e*, 12*f*, and 12*g* on the interior surface of a housing half 15 to hold housing halves 13 and 15 of housing 12 together.

Circular portion 62 has a receptacle or stud that receives one end of a spring 64, the spring 64 having a second end that fits into or on a receptacle 12*a* formed on housing half 13. In one embodiment, receptacle 12*a* is a stud (as shown in FIG. 5A) that extends into the coils of spring 64, although in alternative aspects, receptacle 12*a* may be a groove or a recess that receives the spring 64. Receptacle 12*a* secures spring 64 such that when the end of mounting hub 26 is manually pushed inwards, mounting hub 26 compresses spring 64. Receptacle 12*a* also serves as an axle for rotation of the pivot structure 19. The rotation of pivot structure 19 (by manual rotation of handle 20 of reel crank 16) causes rotation of teeth 63, which engages with correspondingly shaped hole 23*a* in the ring gear 23, to rotate the ring gear 23, as will be appreciated by also looking at FIG. 5B described below. Spring 64 is biased to normally retain teeth 63 at an axial position in which it is aligned to engage with hole 23*a*. However, the pivot structure 19 can be manually pushed inwards by manually pushing in on the end of mounting hub 26 against the bias of spring 64. This axial movement of the pivot structure 19 moves the teeth 63 out of engagement with correspondingly shaped hole 23*a*. As a result, in this position, rotation of the inner ring gear 23 will not cause rotation of the pivot structure 19 or the reel crank 16. This may be desirable when the continuous impregnated chalk line 14 is reeled out of the housing 12, to extend the continuous impregnated chalk line 14, so that rotation of reel 54 during this action does not cause rotation of the reel crank 16.

Figure 5B:
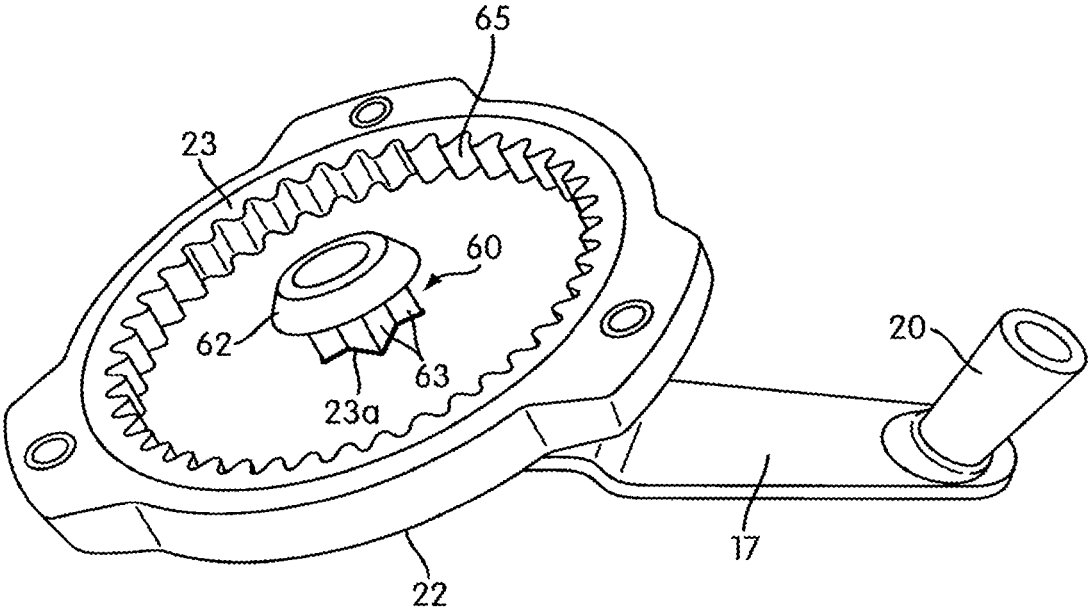
FIG. 5B shows an inner view of a gear member arrangement of the crank mechanism that rotatably attaches to the reel as illustrated in FIG. 5A, in accordance with an aspect of the present disclosure.

FIG. 5B shows inner ring gear 23 with teeth 65 in more detail when looking at a side of ring gear 23 facing a hole 12*h* in housing half 13. As seen in FIG. 5B, through hole 12*h* on housing half 13, the teeth 74 of a gear structure 75 fit through to mesh with the teeth 65 of ring gear 23. When reel crank 16 is rotated, rotational motion is transferred via pivot structure 19 to ring gear 23. In one embodiment, during rotation of ring gear 23, teeth 65 of ring gear 23 mesh with teeth 74 of gear structure 75 and thus rotate gear structure 75.

Referring back to FIG. 5A, gear structure 75 also has a disc-shaped portion 78 having an axial extension 80 that fits into a correspondingly shaped hole 54*a* of rotatable reel 54. Rotation of gear structure 75 thus in turn transfers its rotational motion to rotatable reel 54 via axial extension 80 fitted into hole 54*a*.

Rotatable reel 54 is shaped to have two extended discs 54*a* and 54*b* connected to one another by a central hub (hidden from view in FIG. 5A by a portion 14*b* of continuous impregnated chalk line 14 that is wound on the central hub by discs 54*a*, 54*b*). Continuous impregnated chalk line 14 is extended at portion 14*a* tangentially from the central hub. Rotatable reel 54 of the first housing 12 may have a different reel capacity for storing impregnated chalk line 14 than the second rotatable reel 54 of the second housing 12, as shown in FIG. 1. The capacity of rotatable reel 54 may be sufficient to hold the entire length of the continuous impregnated chalk line 14/14*a*. Upon application of a pulling force P on hook 28, or on the continuous impregnated chalk line 14, by the user of the second housing 12, portion 14*a* straightens out and applies a rotation force to the central hub of reel 54. The central hub of reel 54 can thus be rotated when the impregnated line 14 is pulled.

Support member 38 extends between and is connected to housing halves 13 and 15. The ends of support member 38 fit into a pair of recesses or grooves 38*a* inside housing 12, in the respective housing halves 13, 15 (only one of the pair of grooves 38*a* being shown in FIG. 5A). Member 38 may be formed of a metal or other rigid material. Portion 14*b* extends through the seal structure 58 made of a soft or flexible material and held in cylindrical shape by clip 56, although other shapes may be used as can be contemplated by one of ordinary skill in the art.

Housing 12 includes the one or more pivots or hinges 34 for movable cover 18. In particular, cover 18 has a pivot pin receiving through-hole 34*a*, while housing halves 13, 15 each have pivot pin receiving recesses 34*b*. A pivot pin may be inserted through hole 34*a* and recess 34*b* to enable pivoting movement of cover 18. As noted earlier, movable cover 18 moves about or pivots about hinge or pivot 34 between open and closed positions.

Recess 50 shown on housing 12 accommodates the distal end of handle 20 when reel crank 16 is not in use, or when chalk box 10 is not in use. Recess 50 may include an annular ridge or detents or other structure around the opening of recess 50 that may provide a releasable compressive hold on handle 20. Housing half 15 includes three cylindrical fasteners receiving protrusions 12*e*, 12*f*, and 12*g* that support housing halves 13 and 15 by receiving screws 22*a*-22*c*, respectively. Cylindrical protrusions 12*e*, 12*f*, and 12*g* may be configured to receive additional screws (e.g., screw 22*a*') to provide additional support for securing housing halves 13 and 15 together. Additionally, a cylindrical hollow protrusion 12*i* formed on the interior surface of housing half 15 supports positioning of and smooth rotation of rotatable reel 54 thereabout. In particular, the reel 54 has a cooperative projection or recess (not seen in FIG. 5A) that acts as an axle that rotatably engages with protrusion 12*i*.

Figure 6:
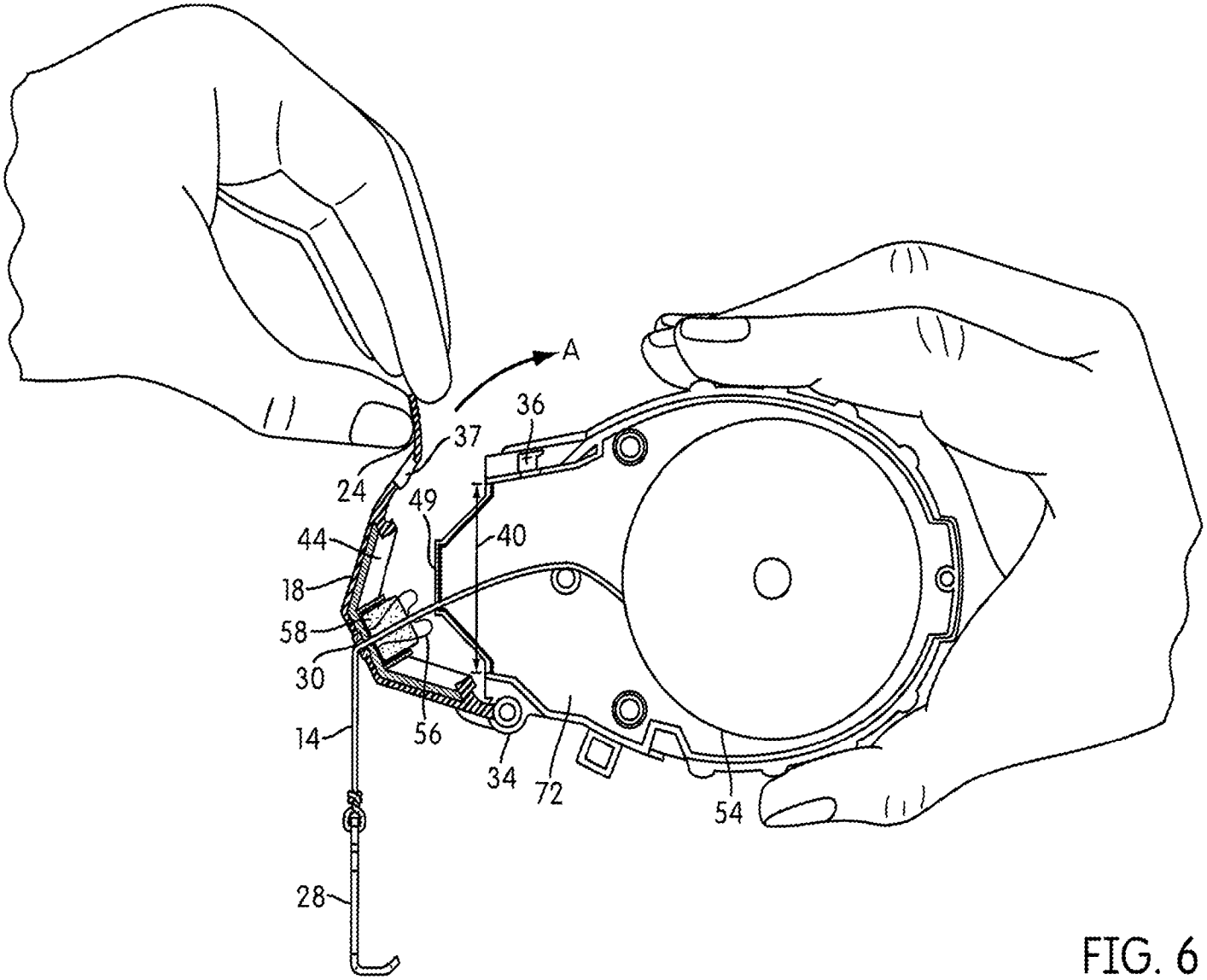
FIG. 6 shows a partial cross sectional view of the reel-to-reel chalk box housing with a movable cover mounted on a housing of the reel-to-reel chalk box and movable between open and closed positions by a user's hands.

FIG. 6 shows an operation of moving pivotable cover 18 to a closed position by a user. For example, the user's fingers are shown pulling on projection 24 in a direction A shown by an arrow to move movable cover 18 in a direction such that opening 37 in the cover 18 can be placed over protrusion 36 on housing 12. As a result, opening 40 can be closed to seal an inside or an interior of chalk bin portion 72 of housing 12.

In FIG. 7, the user pulls or stretches projection 24 on movable cover 18 to align recess or hole 37 thereon with protrusion 36 on housing 12. The user pulls the projection 24 in a direction A' shown by an arrow such that projection 24 can latch on to protrusion 36 by stretching projection 24 (also made of elastomeric material) forming a releasable lock arranged to releasably lock movable cover 18 in the closed position. The elasticity of the projection 24 allows for such stretching and retains the edge around opening 37 in forced engagement. Further, the releasable lock formed by such arrangement of protrusion 36 and projection 24 is manually manipulable by a user's fingers to release the lock to permit access into housing 12. The releasable lock formed by such arrangement of protrusion 36 and projection 24 uses opening 37 to securely seal chalk or marker material inside housing 12.

FIG. 8 shows a close-up view of arrangement of projection 24 on movable cover 18 over protrusion 36 on housing 12 at hole 37 in projection 24. A lip 36*a* on protrusion 36 interlocks with the opening 37 in projection 24, now stretched, to maintain movable cover 18 in a closed position and prevent leakage of chalk or marker material from inside of housing 12. As a result, movable cover 18 securely seals chalk or marker material within housing 12. The open and close positions of movable cover 18 selectively permit or prevent access to interior chalk bin portion 72 of housing 12 through opening 40.

It is to be noted that although in this example, particular shapes and sizes of various elements of chalk box 10 are described, one of ordinary skill in the art after reading this disclosure can contemplate other shapes and sizes of various components of chalk box 10. For example, various holes and gears may be square or other suitable geometric cross-sectional shapes and can be made larger or smaller. In one example, marker material may be in a powder form. Alternatively, marker material may be a fluid material (e.g., a liquid, a paste, or the like) that can be placed into housing 12 when movable cover 18 is in an open position.

Although aspects of chalk box 10 have been described in detail for the purpose of illustration, it is to be understood that such detail is solely for that purpose and that the disclosure is not limited to the disclosed aspects, but, on the contrary, is intended to cover modifications and equivalent arrangements that are within the spirit and scope of the appended claims. In addition, it is to be understood that the present disclosure contemplates that, to the extent possible, one or more features of any aspect can be combined with one or more features of any other aspect.

We claim:

1. A reel-to-reel chalk line apparatus, comprising a first chalk box housing comprising a first rotatable reel, a first crank mechanism connected to the first rotatable reel, a continuous impregnated chalk line wound around the first rotatable reel, and a first chalk bin comprising openings for allowing the passage of the continuous impregnated chalk line;

a second chalk box housing comprising a second rotatable reel, a second crank mechanism connected to the second rotatable reel, the continuous impregnated chalk line wound around the second rotatable reel, and a second chalk bin comprising openings for allowing passage of the continuous impregnated chalk line, and the continuous impregnated chalk line being wound and unwound about the first and second rotatable reels as the first and second crank mechanisms are alternately rotated forward and backward.

2. The reel-to-reel chalk line apparatus of claim 1, wherein the continuous impregnated chalk line comprises a visual indicator positioned along the chalk line.

3. The reel-to-reel chalk line apparatus of claim 1, wherein the continuous impregnated chalk line comprises a slidable visual indicator.

4. The reel-to-reel chalk line apparatus of claim 1, wherein the respective crank mechanisms comprise internal gears and an external crank arm connected to the respective rotatable reels.

5. The reel-to-reel chalk line apparatus of claim 1, wherein the respective crank mechanisms comprise a battery powered motor for actuating the respective rotatable reels.

6. The reel-to-reel chalk line apparatus of claim 1, wherein the respective crank mechanisms comprises a rechargeable battery powered motor for actuating the respective rotatable reels.

7. The reel-to-reel chalk line apparatus of claim 1, wherein the respective chalk bins comprise a chalk substance suitable for impregnating the continuous chalk line as it passes through the chalk bin.

8. The reel-to-reel chalk line apparatus of clam 1, wherein the respective chalk bins comprise a chalk substance comprising a reactive mineral powder, paste, liquid, dye, metal, ceramic, glass, plastic, and or a fiber, or combinations thereof.

9. The reel-to-reel chalk line apparatus of claim 1, wherein the first rotatable reel and the second rotatable reel each have the capacity to reel in substantially the entire length of the continuous impregnated chalk line.

10. A method for a reel-to-reel chalk line apparatus, comprising:

providing a first chalk box housing comprising a first rotatable reel, a first crank mechanism connected to the first rotatable reel, a continuous impregnated chalk line wound around the first rotatable reel, and a first chalk bin comprising openings for allowing the passage of the continuous impregnated chalk line;

providing a second chalk box housing comprising a second rotatable reel, a second crank mechanism connected to the second rotatable reel, the continuous impregnated chalk line wound around the second rotatable reel, and a second chalk bin comprising openings for allowing passage of the continuous impregnated chalk line, and providing the continuous impregnated chalk line being wound and unwound about the first and second rotatable reels as the first and second crank mechanisms are alternately rotated forward and backward.

11. The method for the reel-to-reel chalk line apparatus of claim 10, providing the respective chalk box housings, rotatable reels, crank mechanisms, and chalk bins are identical.

12. The method for the reel-to-reel chalk line apparatus of claim 10, providing the respective chalk box housings, rotatable reels, crank mechanisms, and chalk bins are not identical.

13. The method for the reel-to-reel chalk line apparatus of claim 10, providing the continuous impregnated chalk line comprises an attached impregnated chalk line forming the continuous impregnated chalk line.

14. The method for the reel-to-reel chalk line apparatus of claim 10, providing the continuous impregnated chalk line comprises an attachment to an impregnated chalk line by means of knots, braids, brackets, pins, nails, sticks, barbs, wires, hooks, springs, clasps, and or adhesives, or a combination thereof.

15. The method for the reel-to-reel chalk line apparatus of claim 10, providing the first rotatable reel and the second rotatable reel each have the capacity to reel substantially the entire length of the continuous impregnated chalk line.

16. The method for the reel-to-reel chalk line apparatus of claim 10, providing the first and second rotatable reels each have a different capacity to reel the continuous impregnated chalk line.

17. The method for the reel-to-reel chalk line apparatus of claim 10, providing the respective chalk bins comprise a sealable opening for refilling the respective chalk bins with the chalk substances.

18. The method for the reel-to-reel chalk line apparatus of claim 10, providing the respective chalk bins comprise a chalk substance comprising a reactive mineral powder, liquid, paste, dye, metal, ceramic, glass, plastic, and or a fiber, or combinations thereof.

19. The method for the reel-to-reel chalk line apparatus of claim 10, providing the continuous impregnated chalk line comprises a visual indicator positioned along the chalk line.

* * * * *